United States Patent [19]

Kulesza et al.

[11] 4,310,156

[45] Jan. 12, 1982

[54] ROUND-ABOUT GAME

[75] Inventors: Ralph J. Kulesza, Chicago; John R. Wildman, North Riverside; Burton C. Meyer, Downers Grove, all of Ill.

[73] Assignee: Marvin Glass & Associates, Chicago, Ill.

[21] Appl. No.: 10,833

[22] Filed: Feb. 9, 1979

[51] Int. Cl.[3] ..... A63F 9/00

[52] U.S. Cl. ..... 273/1 GE

[58] Field of Search ..... 273/1 R, 1 E, 1 M, 105.2, 273/1 GD, 1 GG; 272/31 R, 44; 46/145

[56] References Cited

U.S. PATENT DOCUMENTS

| | | | |
|---|---|---|---|
| 2,636,737 | 4/1953 | Levay | 273/1 GD X |
| 2,674,457 | 4/1954 | Rago | 272/31 R X |
| 2,715,530 | 8/1955 | Olsen | 272/31 R X |
| 2,846,223 | 8/1958 | Nelson | 272/44 X |
| 3,247,683 | 4/1966 | Dankner | 46/137 |
| 4,027,424 | 6/1977 | Kilroy, Jr. et al. | 46/137 |
| 4,118,026 | 10/1978 | Todokoro | 273/1 R |
| 4,214,750 | 7/1980 | Shimizu | 273/1 M |

FOREIGN PATENT DOCUMENTS

| | | | |
|---|---|---|---|
| 805439 | 11/1936 | France | 273/1 GG |

*Primary Examiner*—Paul E. Shapiro

*Attorney, Agent, or Firm*—Mason, Kolehmainen, Rathburn & Wyss

[57] ABSTRACT

A round-about game is designed for players to attempt to grab pegs from a playing surface when the pegs are randomly and selectively raised relative to the playing surface for a short period of time. The game includes a housing, the upper part of which defines the playing surface having a plurality of sets of recesses, each set of recesses being disposed at a different distance from a central vertical axis of the housing. Each of the recesses is adapted to receive one of the pegs such that the pegs are not readily removed from the playing surface. A rotatable platform is rotated below the playing surface about the central axis of the housing and has cams disposed thereon to engage the removable pegs resulting in the pegs being raised above the playing surface. The rotation of a starter button extending from the top center of the playing surface energizes a windup motor through a ratchet mechanism so that the platform is maintained stationary. The depression of the starter button initiates play of the game with the rotatable platform being rotated approximately 360° by the windup motor through the ratchet mechanism.

4 Claims, 7 Drawing Figures

Fig 1
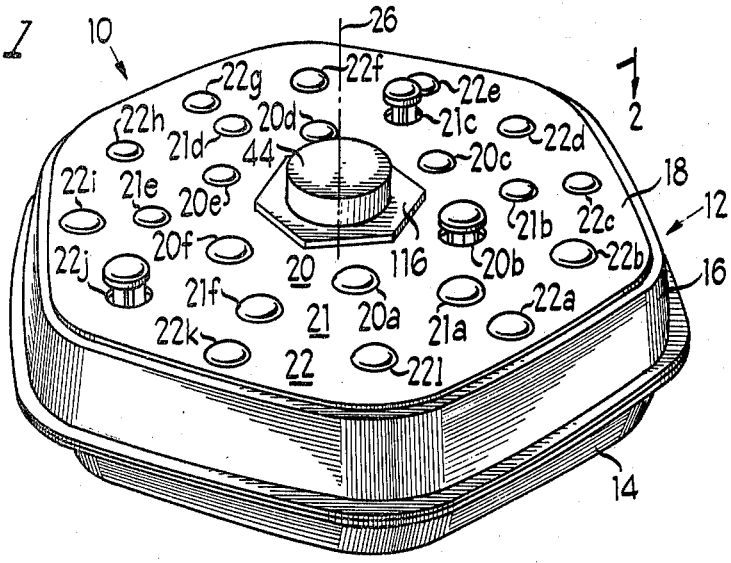
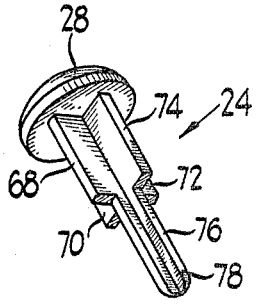
Fig 4
Fig 2
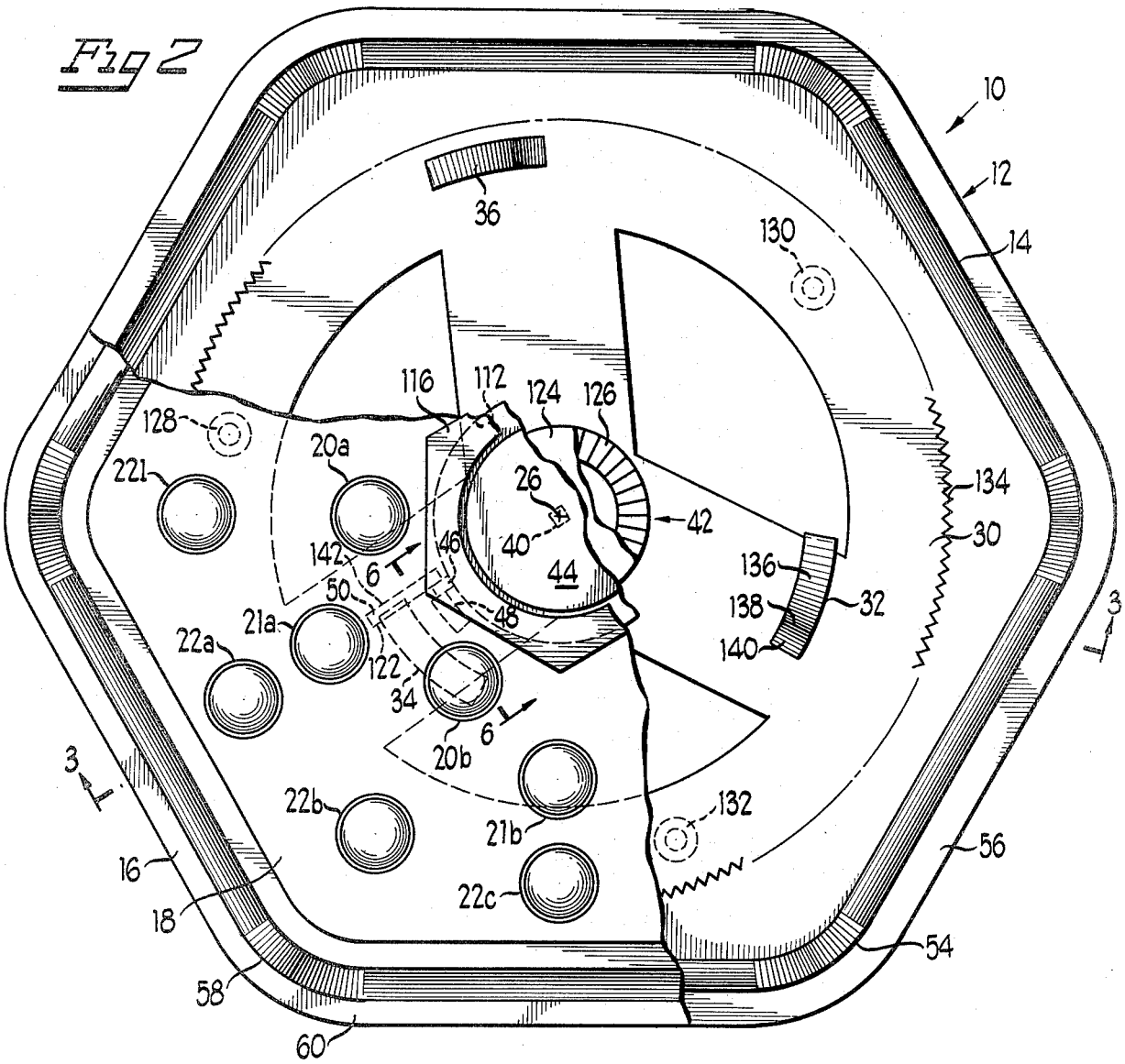

Fig 3
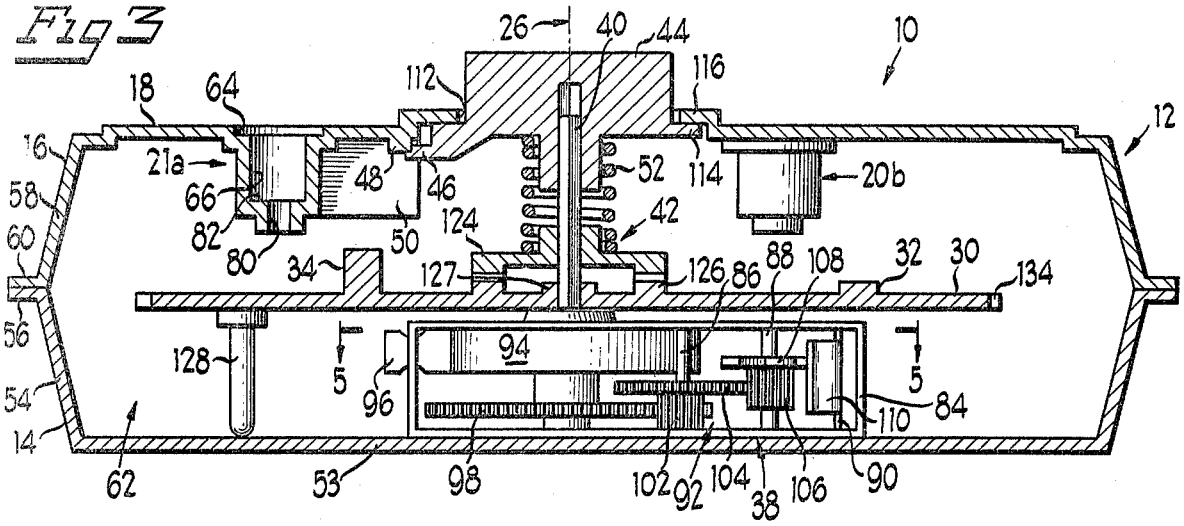
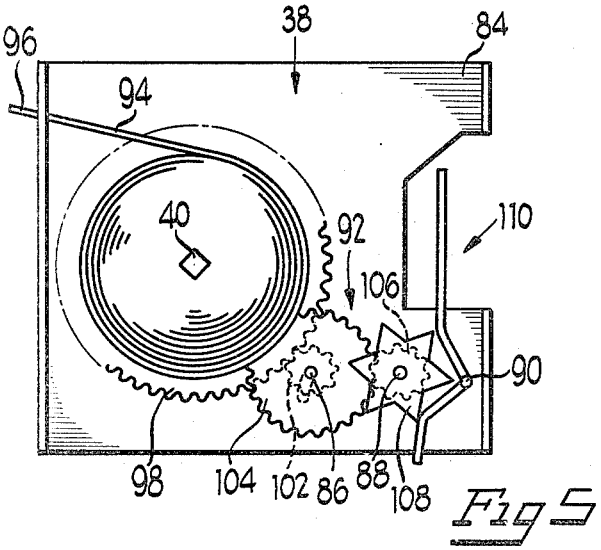
Fig 5
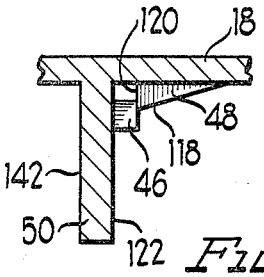
Fig 6
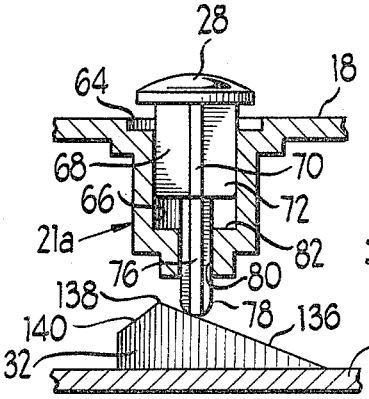
Fig 7

ROUND-ABOUT GAME

BACKGROUND OF THE INVENTION

1. Field of the Invention

This invention relates to amusement devices and, more particularly, to a round-about game where the object is to remove a peg or pegs from a playing surface as the pegs are randomly raised relative to the playing surface for a short period of time.

2. Description of the Prior Art

Round-about toys have enjoyed a great deal of popularity through the years. Some of these toys consist of a figure traveling a given circuitous path on a platform and have been modified for use in games. For instance, in U.S. Pat. No. 3,754,759, a patent assigned to the assignee of record of the present application, a figure is driven about a circuitous path and the object of the game is to have a target on that figure struck by a striking element which is selectively actuated by a player. Another round-about game is disclosed in U.S. Patent Application Ser. No. 876,403, filed on Feb. 10, 1978, which application is assigned to the assignee of record of the present application. In that prior application the round-about game has a striking element that is driven in a circuitous path while being selectively moved in relationship to a playing surface on which can be disposed one or more stationary figures forming targets. The game requires skill on the part of the operator in effecting contact between the moving striking element and the stationary targets which are at varying distances from the playing surface.

Yet another type of game in which a rotating drum is utilized is disclosed in U.S. Pat. No. 3,949,986, which patent is assigned to the same assignee of record of the present application. In that patent a drum is rotated so that information on playing cards is selectively visible through an aperture in the game apparatus. The player accumulates points in that game by conveying the information or images on the playing cards to another player or other players of the game by nonverbal communication.

SUMMARY OF THE INVENTION

Accordingly, it is an object of the present invention to provide a new and improved game in which a playing surface has a plurality of recesses into which one or more pegs may be inserted such that a player cannot remove the pegs from the playing surface. Upon the rotation of a platform beneath the playing surface, a portion of each of the pegs is selectively raised above the playing surface for a short period of time and the player attempts to remove as many pegs as possible as they are randomly raised from the recesses in the playing surface.

Other objects of the present invention are to provide a new and improved round-about game in which players frantically attempt to grab removable pegs from a playing surface as the pegs are selectively raised from the playing surface; to provide a new and improved round-about game in which a number of pegs may be inserted into a playing surface and selectively raised above the playing surface during the play of the game; to provide a new and improved round-about game having a stationary playing surface with a rotatable platform below the playing surface such that objects may be selectively raised above the playing surface by one or more cams situated on the rotating platform; to provide a new and improved round-about game having a platform rotatable about a central axis of a playing surface and having cams situated on the platform below the playing surface at different distances from the central axis so that objects placed in recesses in the playing surface located a distance from the central axis the same as the distance of one of the cams are selectively raised as the cams engage the objects; to provide a new and improved round-about game in which a platform is rotatable below the playing surface by a windup type motor disposed below the platform; to provide a new and improved round-about game wherein a windup type motor is utilized to drive a rotating platform and a ratchet mechanism permits the motor to be energized while the platform remains stationary below the playing surface; to provide a new and improved round-about game having a starter mechanism including a starter button which is depressed to permit a drive mechanism to rotate a platform beneath the playing surface for slightly less than 360°; and to provide a new and improved round-about game in which a single button or knob is used both to initiate the game and to energize a windup type motor used to operate the game.

These and other objects are accomplished in the form of the invention currently contemplated by providing a housing having a bottom base portion and an upper portion defining a top playing surface for a round-about game. The playing surface has a plurality of sets of recesses, each set of recesses being disposed at a different distance from a central vertical axis of the housing and including a plurality of recesses spaced along a plurality of radii extending from the central axis of the housing. The recesses are designed to receive pegs that are shaped such that when disposed within the recesses only a round or convex top grasping portion of the peg is visible from the top of the playing surface and the pegs cannot be readily removed from the playing surface. A rotatable platform is rotatable below the playing surface about the central axis of the housing and has cams positioned at the same distance from the central axis as the sets of recesses which are designed to engage the removable pegs as the platform is rotated so as to raise the top grasping portions of the pegs above the playing surface for a short period of time to permit players to attempt to remove the pegs from the playing surface. A rotatable starter button extends from the top center of the playing surface and is connected through a ratchet mechanism to the rotatable platform and to a windup type motor located below the rotatable platform. The ratchet mechanism permits a motor to be wound as the starter button is rotated in a clockwise direction while allowing the platform to remain stationary. When the motor is completely wound the starter button has a stop tab that extends below the playing surface and is positioned between a stop extending downwardly from the playing surface and a starter cam also extending down from the playing surface. The depression of the starter button allows the stop tab to become disengaged from the starter cam and the windup motor drives the rotatable platform through the ratchet mechanism slightly less than 360° until the stop tab engages the stop. While the rotatable platform is driven by the windup type motor the cams on the rotatable platform selectively and randomly raise the pegs above the playing surface during the play of the game.

BRIEF DESCRIPTION OF THE DRAWINGS

FIG. 1 is a perspective view of the game of the present application and embodying the present invention;

FIG. 2 is a cross-sectional view taken along line 2—2 of FIG. 1;

FIG. 3 is a cross-sectional view of the game of FIG. 1 taken along line 3—3 of FIG. 2;

FIG. 4 is a perspective view of one type of peg or removable object that can be used in the game of FIG. 1;

FIG. 5 is a cross-sectional view partly cut-away taken generally along line 5—5 of FIG. 3;

FIG. 6 is a partial cross-sectional view taken generally along line 6—6 of FIG. 2; and FIG. 7 is a partly cross-sectional, partly elevational view showing how a peg is raised from the playing surface of the game of FIG. 1 as the game is played.

While this invention is susceptible of the embodiment of many different forms, there is shown in the drawings and will herein be described in detail a specific embodiment therefor, with the understanding that the present disclosure is to be considered an exemplification of the principles of the invention and is not intended to limit the invention to to embodiment illustrated.

DESCRIPTION OF THE PREFERRED EMBODIMENT

Referring now more specifically to FIG. 1 of the drawings, therein is disclosed a round-about type game which is generally designated by the number 10 which embodies the present invention. The game 10 includes a housing 12 which, in the disclosed embodiment, is hexagonal in shape but may be made in any other appropriate configuration. The housing 12 is formed by a generally hexagonal-shaped bottom base portion 14 and an upper hexagonal-shaped portion 16 defining a playing surface 18 for the round-about game 10. The playing surface 18 has disposed therein three sets of recesses 20, 21 and 22 which are adapted to receive therein pegs, such as the peg 24 shown in FIG. 4 of the drawings.

The sets of recesses 20, 21 and 22 respectively include recesses 20*a*–20*f*, 21*a*–21*f* and 22*a*–22*l*. Each of the recesses 20*a*–20*f* inclusive in the set of recesses 20 is disposed approximately the same distance from a central vertical axis 26 extending through the housing 12. Similarly, each of the recesses 21*a*–21*f* in the set of recesses 21 is disposed in the playing surface 18 the same distance from the central axis 26, but a distance greater than where the recesses 20*a*–20*f* are disposed, and each of the recesses 22*a*–22*l* is disposed the same distance from the central axis 26, but a distance farther from the central axis 26 than the recesses 21*a*–21*f*. In each of the recesses 20*a*–20*f*, 21*a*–21*f* and 22*a*–22*l* or in any number of those recesses, a peg 24 may be inserted. When the peg 24 is inserted into any given recess, only a convex top portion 28 appears at the top of the recess so that a player of the game 10 cannot remove the peg 24 from the recess.

A rotatable platform 30 is located within the housing 12 and below the playing surface 18. The rotatable platform 20 has three cams 32, 34 and 36 disposed thereon. The cam 34 is disposed the same distance from the central axis 26 of the housing 12 as is the set of recesses 20*a*–20*f*; the cam 32 is disposed on the rotatable platform 30 the same distance from the central axis 26 as the recesses 21*a*–21*f* and the cam 36 is positioned on the rotatable platform 30 the same distance from the central axis 26 as the recesses 22*a*–22*l*. Hence, as the rotatable platform 30 is rotated below the playing surface 18, the cam 34 engages any pegs 24 in the set of recesses 20 such as illustrated in connection with the peg 24 in the recess 20*b* and raises the peg 24 up from the playing surface 18 so that a player can grasp the top grasping portion 28 of the peg 24. Likewise, the cam 32 engages any pegs 24 located in the set of recesses 21 and the cam 36 engages the bottom portion of the pegs 24 located in the set of recesses 22.

In order to rotate the platform 30 beneath the playing surface 18, there is provided a windup type motor 38 which is secured to the base portion 14 of the housing 12 and has a shaft 40 that extends through the platform 30 and a ratchet mechanism 42 into a starter button 44 disposed in the playing surface 18 along the central axis 26. In order to wind the motor 38 or energize it, the starter button 44 is rotated clockwise as viewed in FIGS. 1 and 2 until a stop tab 46 on the starter button 44 is disposed between a starter cam 48 and a stop 50 extending downwardly from the playing surface 18. The ratchet mechanism 42 permits the windup motor 38 to be wound or energized while the rotating platform 30 remains stationary below the playing surface 18.

In order to initiate the rotation of the platform 30 and start the play of the game 10, the starter button 44 is depressed downwardly as viewed in FIG. 3 against the force of a spring 52 until the stop tab 46 disengages from the start cam 48. The windup motor 38 rotates the shaft 40 and through the ratchet mechanism 42 rotates the platform 30 and rotates the starter button 44 in a counterclockwise direction (the direction of the arrows in FIGS. 2 and 7). The windup motor 38 continues to rotate the platform 30 below the playing surface 18 until the stop tab 46 engages the stop 50. As the rotatable platform 30 is rotated, the cams 34, 32 and 36 thereon selectively and randomly raise various ones of the pegs 24 located in the sets of recesses 20, 21 and 22. As the pegs 24 are so raised, players attempt to grab the pegs 24.

As indicated heretofore, the housing 12 includes a bottom base portion 14. The base portion 14 is a hexagonally shaped bowl with a bottom or base 53 and a sidewall 54 having a lip 56 extending about the upper periphery of the sidewall 54. The other part 16 of the housing 12 is a generally inverted hexagonally shaped bowl having a sidewall 58 with a lip 60. The lips 56 and 60 can be bonded together so as to form the housing 12 for the game 10 and provide an internal cavity 62 which is not accessible to the players of the game 10.

The upper portion 16 of the housing 12 includes at the top thereof the playing surface 18. As previously indicated, the playing surface 18 has a plurality of recesses 20*a*–20*f*, 21*a*–21*f* and 22*a*–22*l* disposed therein in three sets of recesses 20, 21 and 22 respectively. As illustrated in connection with the recesses 21*a* and 20*b* particularly shown in FIG. 3, each of the recesses in the sets of recesses 20, 21 and 22 are shaped to receive the pegs 24. More specifically, as illustrated in connection with recess 21*a*, each of the recesses in the sets of recesses 21, 21 and 22 has an enlarged diameter recess portion 64 adjacent the top of the playing surface 18 into which the top convex grasping portion 28 of the peg 24 may be disposed. A smaller diameter recess portion 66 interconnects with the portion 64 and is designed to receive vanes 68, 70, 72 and 74 extending outwardly from a shank 76 of the peg 24 just below the grasping portion 28. A lower part 78 of the shank 76 slides into a smaller diameter portion 80 in the recess 21*a*. When the peg 24 is lodged in the recess 21*a*, the vanes 68, 70, 72 and 74 rest against a shelf 82 formed at the bottom of the opening 66 so that the peg 24 is disposed in the recess 21*a*. Moreover, when the peg 24 is so lodged in a recess 21*a*, the lower portion 78 of the shank 76 extends out from the opening 80 so that it may be engaged by one of the cams 32, 34, 36 and in the case of recess 21*a*, the cam 32, as the rotatable platform 30 is rotated below the playing surface 18.

The rotatable platform 30 is rotated by means of the windup motor 38. The windup motor 38 is located in the cavity 62 formed by the housing 12 and has a supporting frame structure 84 secured to the base 53 of the base portion 14. The frame structure 84 has a hole through which the main vertical shaft 40 extends and three additional vertical shafts 86, 88 and 90 are located within the supporting structure 84 and support the elements of a step up gear train 92. A coil spring 94 is fixed to the main vertical shaft 40 and has a slotted end portion 96 affixed to the supporting structure 84 to yieldingly resist the turning of the main shaft 40 and to urge the rotation of the main vertical shaft 40 in a counterclockwise direction as viewed in FIGS. 1 and 2.

A gear 98 is keyed to the main vertical shaft 40 and has its toothed portion in position for engagement with the step up gear train 92. The gear train 92 includes a pinion gear 102 mounted on the shaft 86 which pinion gear 102 engages the gear 98. Another larger gear 104 is also affixed on the shaft 86 and engages another pinion gear 106, which pinion gear 106 is mounted on the shaft 88. By virtue of the gear train 92, the shaft 88 rotates at a substantially faster rate than the main vertical shaft 40. The shaft 88 also has a star gear 108 rotatable mounted thereon and adapted to engage a bifurcated element 110 having its midportion disposed for pivotal rotation relative to the shaft 90.

The winding of the shaft 40 in a clockwise direction as viewed in FIGS. 1 or 2 causes the spring 94 to be coiled or to be in a resiliently biased configuration. When the shaft 40 is released for rotational movement under the influence of the windup motor 38, as by depressing the starter button 44 so that the stop tab 46 becomes disengaged from the starter cam 48, the unwinding of the spring 94 and its pressure against the frame 84 through the attachment end 96 causes the gear 98 to move in a counterclockwise direction as viewed in FIG. 5 in engagement with the pinion gear 102. As the pinion gear 102 moves it causes the gear 104 to move in a clockwise direction as viewed in FIG. 5 in engagement with the pinion gear 106. The movement of the pinion gear 106 causes the star gear 108 to rotate in a counterclockwise direction causing the gear train 92 to operate.

As the star gear 108 rotates it alternately strikes opposite ends of the bifurcated element 110 so as to provide a governor for regulating the speed of the gear train 92 and also to provide a noise similar to a ticking sound. The ticking sound is thus generated whenever the rotatable platform 30 is rotated beneath the playing surface 18 and more specifically during the playing of the game 10.

As indicated heretofore, the windup motor 38 is energized by the rotation in a clockwise direction of the starter button 44. More specifically, the shaft 40 is affixed or keyed to the starter button 44. The starter button 44 is lodged in an opening 112 in the center of the playing surface 18 by the interaction of a ledge 114 extending about the button 44 from which ledge 114 the stop tab 46 extends, and a ridge 116 on the playing surface 18 formed about the opening 112. In this manner the starter button 44 is free to rotate and be rotated in the opening 112. As the starter button 44 is rotated in a clockwise direction, the stop tab 46 engages a cam surface 118 on the starter cam 48. As the stop tab 46 slides along the cam surface 118, the starter button 44 is depressed or moved downwardly in FIG. 3 against the upward force of the spring 52. Finally, when the stop tab 46 travels to the end of the cam surface 118, it lodges between a side edge 120 of the stop cam 48 and a side edge 122 of the stop member 50. The force of the spring 52 on the starter button 44 pushes the starter button 44 upward in FIG. 3 so that the stop tab 46 is maintained disposed between the side edge 122 and the side edge 120, as particularly illustrated in FIGS. 2, 3 and 6 of the drawings.

As the starter button 44 is rotated in the clockwise direction to energize the windup motor 38, the platform 30 is not rotated due to the ratchet mechanism 42. More specifically, the ratchet mechanism 42 includes a ratchet wheel 124 which is keyed to the shaft 40 and is rotated as the shaft 40 is rotated. The ratchet mechanism 42 also includes a second ratchet wheel 126 which is integrally formed with the rotatable platform 30. The shaft 40 is not keyed to the rotatable platform 30 but rather passes through a hole 127 in the central portion of the rotatable platform 30. As the ratchet wheel 124 is rotated in the clockwise direction due to the rotation in that direction of the starter button 44, the ratchet wheel 126 is not rotated because the ratchet wheels 124 and 126 have inclined teeth designed such that the teeth of the ratchet wheel 124 do not engage the teeth of the ratchet wheel 126 as the ratchet wheel 124 is rotated in the clockwise direction. However, the teeth of the ratchet wheels 124 and 126 do engage as the ratchet wheel 124 is rotated in the counterclockwise direction by the motor 38 such that the rotatable platform 30 will be rotated also in that direction.

As the rotatable platform 30 is rotated in the counterclockwise direction, the cams 32, 34 and 36 engage various ones of the pegs 24 inserted in the sets of recesses 20, 21 and 22 in the playing surface 18. The platform 30 may include supports 128, 130 and 132 in order to give the platform 30 more stability as the cams 32, 34 and 36 engage the shaft portion 78 of the pegs 24. As best seen in FIG. 3 and illustrated in connection with the support 128, each of the supports 128, 130 and 132 engage and slide along the base 53 of the bottom portion 14 of the housing 12. This provides the platform 30 with sufficient rigidity to enable the pegs 24 to be raised during the play of the game 10.

It is noted that the rotatable platform 30 along the outer peripheral edge 134 is serrated so that the platform 30 may be selectively driven by a mechanism other than the windup motor 38. However, in the preferred embodiment disclosed in the present application, no such mechanism is disclosed.

As previously indicated, each of the cams 32, 34 and 36 are designed to engage the bottom shaft 78 of the pegs 24. As more particularly illustrated in FIG. 7 in connection with the cam 32, each of the cams 32, 34 and 36 has a cam surface 136 extending from the rotatable platform 30 and designed to engage the bottom of the shaft 78 of the peg 24 located in one of the recesses such as illustrated in FIG. 7 with respect to the recess 21*a*. As the shaft portion 78 slides along the cam surface 136 the peg 24 is forced upwardly in FIG. 7 so that the top grasping portion 28 is dislodged from the larger diameter opening 64 of the recess 21*a*. As the peg 24 is so raised from the recess 21*a*, a player may grasp the peg 24 and remove the peg 24 completely from the recess 21*a*. Once the shaft portion 78 reaches a pinnacle 138 of the cam surface 136, the shaft 78 slides along a smaller cam surface 140 so the peg 24 slowly is lowered into the recess 21*a*. Once the shaft 78 drops off the cam surface 140, the peg 24 abruptly returns to its position in the recess 21*a*.

As can be appreciated from the foregoing, the play of the game 10 is relatively simple and can be enjoyed by any number of players. One of the players of the game 10 may set pegs 24 in any number or all of the recesses 20*a*–20*f*, 21*a*–21*f* and 22*a*–22*l* located in the playing surface 18. The starter button 44 is rotated in a clockwise direction in order to energize the windup motor 38 until the stop tab 46 is lodged between the starter cam 48 and the stop member 50. That same player or another player then presses the starter button 44 so as to release the stop tab 46 from the starter cam 48. The windup motor 38 through the main shaft 40 rotates the starter button 44 and the platform 30 by means of the ratchet mechanism 42 in a counterclockwise direction as viewed in FIGS. 1 and 2. As the rotatable platform 30 is rotated in the counterclockwise direction, the cams 32, 34 and 36 randomly and selectively engage the various ones of the pegs 24 that have been lodged in the recesses 20*a*–20*f*, 21*a*–21*f* and 22*a*–22*l*. As any one of the pegs 24 is raised above the playing surface 18, for instance as shown in FIG. 1, the pegs 24 disposed in the recesses 20*b*, 21*c* and 22*j*, one of the players attempts to remove the raised pegs 24 by grasping the top portion 28 of the peg 24. The pegs 24 so raised by the cams 32, 34 and 36 are only raised above the playing surface 18 for a short period of time so that the player attempting to remove the pegs 24 frantically tries to grasp the different ones of the pegs 24 as they are raised by the cams 32, 34 and 36. The skill required can be changed by changing the speed of the game by regulating the speed the motor 38 rotates the rotatable platform 30 beneath the playing surface 18.

Once the starter button 44 and the rotatable platform 30 below the playing surface 18 have been rotated close to 360°, the stop tab 46 engages a side edge 142 of the stop member 50 and thereby limits the rotation of the rotatable platform 30 to essentially one rotation for each time the starter button 44 is depressed after it has been wound in a clockwise direction. In this manner, each of the pegs 24 in the recesses 20*a*–20*f*, 21*a*–21*f* and 22*a*–22*l* is raised only one time for each play of the game 10 or for each rotation of the platform 30.

Obviously, the object of the game 10 is for a player to grasp as many pegs 24 during each individual rotation of the platform 30 or the play of the game 10. After a given number of turns for each of the players with respect to a rotation of the platform 30, the player who has removed the most number of pegs 24 is declared the winner of the game 10.

Certainly different variations of the play or the scoring for the game 10 can be devised. In the play of the game 10, a number of pegs 24 that are inserted into the recesses 20*a*–20*f*, 21*a*–21*f* and 22*a*–22*l* may be varied or the number of rotations of the platform 30 for a given player to attempt to remove the pegs 24 may also be varied. Moreover, different color pegs 24 may be used in various ones of the recesses 20*a*–20*f*, 21*a*–21*f* and 22*a*–22*l* with each different color peg 24 being worth a different value for each time the peg 24 is removed from the playing surface 18. Another variation in the play of the game 10 either by a single player or a number of players is to permit the player or players to have the rotatable platform 30 rotated a number of times in order for the player to remove all the pegs 24 from the playing surface 18. The winner of the game 10 could then be the player removing all the pegs 24 in the least amount of plays of the game 10.

The foregoing detailed description has been given for clearness of understanding only and no unnecessary limitations should be understood therefrom as some modifications will be obvious to those skilled in the art.

What is claimed to be new and desired to be secured by Letters Patent of the United States is:

1. A game apparatus comprising:

housing means having a base portion and an upper portion defining a playing surface, said playing surface having receiving means therein, movable means insertable into said receiving means, said movable means having a first portion which barely protrudes from said playing surface when said movable means is disposed in said receiving means, platform means rotatably mounted in said housing below said playing surface and having actuating means thereon to selectively contact said movable means, said first portion of said movable means extending out from said playing surface when said actuating means contact said movable means, drive means mounted on said base portion of said housing means to rotate said platform means below said playing surface, a rotatable shaft means rotatable by said drive means, a rotatable start means on said playing surface affixed to said shaft means, first ratchet means constrained to rotate with said shaft means and second ratchet means affixed to said rotatable platform means, said first and second ratchet means permitting the rotation of said shaft means in a first circumferential direction while said platform means remains stationary and rotating said platform means in said second circumferential direction when said rotatable shaft means is rotated by said drive means, and start cam means and stop means extending from said playing surface, said start means contacting said start cam means and being lodged between said start cam means and said stop means when said start means is rotated in said first circumferential direction.

2. The game apparatus as set forth in claim 1, wherein said drive means is energized by the rotation of said start means in said first circumferential direction.

3. A game apparatus comprising:

housing means having a base portion and an upper portion defining a playing surface, said playing surface having receiving means therein, movable means insertable into said receiving means, said movable means having a first portion which barely protrudes from said playing surface when said movable means is disposed in said receiving means, platform means rotatably mounted in said housing below said playing surface and having actuating means thereon to selectively contact said movable means, said first portion of said movable means extending out from said playing surface when said actuating means contact said movable means, drive means mounted on said base portion of said housing means to rotate said platform means below said playing surface, a rotatable shaft means rotatable by said drive means, a rotatable start means on said playing surface affixed to said shaft means, first ratchet means constrained to rotate with said shaft means and second ratchet means affixed to said rotatable platform means, said first and second ratchet means permitting the rotation of said shaft means in a first circumferential direction while said platform means remains stationary and rotating said platform means in said second circumferential direction when said rotatable shaft means is rotated by said drive means, start cam means and stop means extending from said playing surface, said start means contacting said start cam means and being lodged between said start cam means and said stop means when said start means is rotated in said first circumferential direction, and spring means against which said start means may be depressed so as to release said start means from between start cam means and said stop means and permit the rotation of said shaft means in said second circumferential direction by said drive means through substantially 360° until said start means contacts said stop means.

4. The game apparatus as set forth in claim 3, wherein said drive means is energized by the rotation of said start means in said first circumferential direction.

* * * * *